United States Patent [19]

Salavin et al.

[11] Patent Number: 5,075,597

[45] **Date of Patent: * Dec. 24, 1991**

[54] METHOD FOR THE ROW-BY-ROW CONTROL OF A COPLANAR SUSTAINING AC TYPE OF PLASMA PANEL

[75] Inventors: Serge Salavin, St. Egreve; Jacques Deschamps, Grenoble; Michel Gay, Le Fontanil; Michel Specty, Echirolles, all of France

[73] Assignee: Thomson-CSF, Puteaux, France

[ * ] Notice: The portion of the term of this patent subsequent to Jul. 9, 2008 has been disclaimed.

[21] Appl. No.: 396,683

[22] Filed: Aug. 22, 1989

[30] Foreign Application Priority Data

Aug. 26, 1988 [FR] France ..... 88 11247

[51] Int. Cl.[5] ..... G09G 3/10

[52] U.S. Cl. ..... 315/169.4; 315/169.1; 340/771; 340/775

[58] Field of Search ..... 315/169.4, 169.1, 169.3; 340/805, 771, 772, 775, 776, 777, 813; 313/585, 584

[56] References Cited

U.S. PATENT DOCUMENTS

| | | | |
|---|---|---|---|
| 4,737,687 | 4/1988 | Shinoda et al. | 315/169.4 |
| 4,866,349 | 9/1989 | Weber et al. | 315/169.4 |
| 4,914,352 | 4/1990 | Gay et al. | 315/169.4 |
| 4,924,218 | 5/1990 | Weber et al. | 315/169.4 X |

FOREIGN PATENT DOCUMENTS

| | | |
|---|---|---|
| 0135382 | 3/1985 | European Pat. Off. . |
| 0149381 | 7/1985 | European Pat. Off. . |
| 0193646 | 9/1986 | European Pat. Off. . |
| 0266462 | 5/1988 | European Pat. Off. . |

OTHER PUBLICATIONS

Proceedings of the SID, vol. 22, No. 4, 1981, pp. 204–212, IEEE, Los Angeles, CA, U.S.; T. N. Criscimagna, et al., "Write and Erase Waveforms for High-Resolution AC Plasma Display Panels".

Proceedings of the SID, vol. 27, No. 3, 1986, pp. 183–187, IEEE, N.Y., U.S.; G. W. Dick, "Three-Electrode-Per-Pel AC Plasma Display Panel".

*Primary Examiner*—Eugene R. Laroche
*Assistant Examiner*—Ali Neyzari
*Attorney, Agent, or Firm*—Oblon, Spivak, McClelland, Maier & Neustadt

[57] ABSTRACT

Disclosed is a method for the row-by-row control of the pixels of a plasma panel. This method is applicable in the case where a pixel is defined at the intersection of a column electrode with a pair of sustaining electrodes. The method disclosed makes it possible to obtain, notably, a reduced cycle time with a small number of voltage levels applied to the different electrodes. To this effect, according to one characteristic of the invention, the method consists in the erasure of the pixels of a row solely by erasing discharges generated between the electrodes of the corresponding electrode pair.

11 Claims, 3 Drawing Sheets

METHOD FOR THE ROW-BY-ROW CONTROL OF A COPLANAR SUSTAINING AC TYPE OF PLASMA PANEL

BACKGROUND OF THE INVENTION

1. Field of the Invention

The present invention concerns a method for the row-by-row control of a coplanar sustaining AC type of plasma panel, particularly a plasma panel wherein each elementary picture element is defined substantially at the intersection of a first electrode, called a "column electrode", with two other parallel electrodes, called "sustaining electrodes".

2. Description of the Prior Art

Plasma panels are flat panel or screen display devices that enable the display of alphanumerical, graphic or other images, in color or otherwise. These panels work on the principle of an emission of light produced by an electrical discharge in a gas.

Generally, plasma panels comprise two insulating plates bounding a volume occupied by a gas (generally a neon-based mixture). These plates support conductive electrodes intersecting so as to define a matrix of picture elements or pixels. An electrical discharge in the gas, causing an emission of light at a cell or pixel, takes place when the electrodes of this pixel are suitably excited.

Although certain plasma panels work in DC mode, it is most commonly preferred to use AC type panels, the working of which is based on an excitation of the electrodes in AC mode. The electrodes are coated with a layer of dielectric material. They are therefore no longer in direct contact either with the gas or with the discharge.

The working of an AC type plasma panel, with two intersecting electrodes, to define a pixel is known, notably from a French patent No. 78 04893, filed on behalf of THOMSON-CSF and published under No. 2 417 848. This patent also describes a method for the erasure of the pixels of a panel such as this, as well as various types of signals that are applied to the cells (the gaseous space between two intersecting electrodes, i.e. at the pixel) of a plasma panel, notably writing, sustaining and erasing signals:

The writing signal is formed by a voltage pulse, with an amplitude at least equal to the triggering voltage of the gas of the cell. The cell emits a brief light pulse, for the electrical charges created by ionization of the gas cannot reach the electrodes, which are isolated by dielectric layers. These charges get deposited on the dielectric layers and create an internal electrical field that counters the electrical field induced by the writing signal and grows until it causes the cell or pixel to be extinguished. The cell keeps the previously acquired internal field in memory, and it is then said to be at the state 1 or written state, whereas a pixel having an almost null internal field is said to be at the state 0 or erased state. Thus, the writing signal enables the cells ot pixels that are at the state 0 to be set at the state 1.

The sustaining signal stores the information of a cell in the "written" state. Thus sustaining signal is formed by an AC voltage which, twice per period, lights up a cell which is already in the written state. The internal field, memorized by a cell or pixel in the written state, makes it possible to light up this pixel by a sustaining signal with an amplitude that is smaller than the triggering voltage. At each ionization of the gas of the cell or pixel, caused by a sustaining discharge, the internal field gets cancelled and an internal field with a sign opposite to the previous one charges the cell or pixel.

The erasing signal enables one or more or all the cells or pixels of the panel to be placed in the state 0 or erased state. The erasing signal does not modify the state of the cells that are already in the state 0. The erasure of a cell consists in causing a triggering of erasure, namely an ionization of the gas of this cell with, for example, an intensity that is just enough to cancel the charges that have collected on the dielectric layers facing the electrodes. Thus, for example, there are known ways to erase a cell in the state 1, in using a voltage pulse, calibrated in time and amplitude, which ionizes the gas of the cell and cancels its internal field, without generating a new field, unlike what is obtained with a sustaining signal. To this effect, it is possible to use a voltage pulse in the form of square waves, having either a high amplitude and a short duration or a low amplitude and a long duration.

The above-mentioned patent application further explains how the erasure or one or more cells is done by means of an erasing signal, the rising edge of which is formed by a slope.

With a view, notably, to improving the luminance of the plasma panels and also to enabling the display of several colors, it is preferred to use plasma panels which are of the type excited in AC mode a mentioned above and which, in addition, have coplanar sustaining. In panels of this latter type, called coplanar sustaining plasma panels, each pixel of the matrix is formed by three electrodes, more precisely at the intersection between an addressing electrode, called a column electrode, and two parallel sustaining electrodes forming a pair of sustaining electrodes. In this type of panel, the sustaining of the discharges is done between the two sustaining electrodes of one and the same pair, and the addressing is done by the generation of discharges between two intersecting electrodes. The term "addressing" refers to discharges generated selectively or semi-selectively in order to achieve a writing or erasing operation.

Thus the sustaining electrodes form two classes: the electrodes of a first class are called "addressing-sustaining" electrodes, while the electrodes of a second class are called "solely sustaining electrodes". The addressing-sustaining electrodes have the function of setting up the sustaining discharges in cooperation with the solely sustaining electrodes (of the second class). But they also have to fulfil an addressing role. Consequently, they are individualized, that is, they must, for example, bed connected to one or more pulse generating devices through means that enable one or more particular pulses to be applied to only one or to more addressing-sustaining electrodes which are selected from among the plurality of addressing-sustaining electrodes.

Of course, the column electrodes are also individualized.

As for the solely sustaining electrodes (of the second class), they are generally connected to one or more pulse generators in such a way that these solely sustaining electrodes are all, at the same instants, carried to the same potentials, so that they do not need to be individualized and may, if necessary, be connected to one another.

Among the advantages provided by the structures where a pixel is defined at the intersection of a column electrode with a pair of sustaining electrodes, we might cite greater luminance. This is due notably to the fact that the sustaining discharges between the two sustaining electrodes occur on a surface that goes beyond the surface of intersection with the column electrode. This means that the useful light is not blocked by this column electrode which is generally mounted on the side with the plate by which the plasma panel is looked at.

It must be noted that the addressing/sustaining electrodes and solely sustaining electrodes each have, at each pixel, a protuberance or projecting surface. In one and the same pair of sustaining electrodes, the projecting surfaces of one electrode are pointed towards the projecting surfaces of the other electrode, and the sustaining discharges occur between these projecting surfaces.

A plasma panel such as this is known notably from the European patent document EP-A-O 135 382 which also describes a method for the control of this panel. It must be noted that, in the device described in this European patent, the column electrode intersects the pairs of sustaining electrodes on the side of the projecting surfaces where the sustaining discharges are produced.

Another structure of the type wherein each pixel is defined at the intersection of a column electrode with a pair of sustaining electrodes, as well as an adapted control method, are described in the article by G.W. DICK in PROCEEDINGS OF THE SID, vol 27/3, 1986, pages 183–187. It must be noted that, in the structure described in this document, the sustaining electrodes have a constant width, that is, they have no facing, projecting surfaces in a pair of sustaining electrodes, to define the sustaining discharge zone. By contrast, this structure has barriers made of an insulating material. These barriers serve to confine sustaining discharges in the zone of intersection with the column electrode.

Another type of plasma panel, to which the method of the invention can be applied in a particularly worthwhile way, is shown in FIG. 1. A panel of this type is the object, in itself, of a French patent application No. 88 03953 filed on 25th Mar. 1988 on behalf of THOMSON-CSF. Since this French patent application has not been published to date, the new type of plasma panel to which it refers is described hereinafter.

The panel shown in FIG. 1 has a first glass plate 10 covered with a first class of electrodes marked Xj where j is a whole number ranging from 1 to N (only one electrode Xj is shown; the set formed by the plate 10 and the electrode Xj is coated with a layer 12 of dielectric material, which may be covered with a layer of oxide such as MgO (not shown), facilitating electronic emission. On the dielectric layer 12, there is a patch 14 of a luminophor material, namely a material capable of emitting a colored radiation under the effect of an ultra-violet radiation.

The panel further has a second glass plate 20 coated with a second class of electrodes formed by pairs of electrodes, respectively called sustaining-addressing electrodes (Yae)i and sustaining electrodes (Ye) where i is a whole number in the range of 1 to P. The sustaining-addressing and sustaining electrodes include protruberances or projecting surfaces 22 and 24, placed so as to face each other. The set formed by the plate 20 and the electrodes is coated with a dielectric layer 26.

In normal operation, the two plates 10 and 20 and their networks of electrodes are brought close together and kept apart by a shim (not shown), there is a gas in the volume between the plates and the shim. Once the panel is mounted, it thus has two networks of orthogonal electrodes, in the sense that the electrodes Xj are orthogonal to the electrodes (Yae)i and (Ye). The electrodes Xj may overlap the protruberances 22 and 24, or may be slightly offset on their side. A pixel Pij is then defined by an electrode Xj (a column electrode) and a pair of sustaining electrodes (Yae)i and (Ye).

If the above-described plasma panel or the other previously described plasma panes are controlled by a known control method, it is observed, the working of these panels may have one or more of the faults mentioned below:

The pulses applied to the different electrodes may have many levels of voltages, resulting in a complication of the pulse generators and of the number of selective addressing means;

The duration of the total cycle is long, resulting in incompatibility with operation in fast systems of the video type for example (by analogy with the pictures produced by cathode-ray tubes where an image is defined line by line) and possibly resulting in low luminance due to the low frequency of the sustaining discharges;

The writing and/or erasure of the pixels requires several discharges with the column electrode, resulting in requires several discharges with the column electrode, the possible result of this being a highly accelerated degradation of the luminiphors (used in the latest technologies to modify the coloring of the light emitted).

SUMMARY OF THE INVENTION

The control method according to the invention enables the removal or considerable diminishing of the above-mentioned drawbacks. The proposed control method is of the video scanning type, that is, it enables a complete line addressing operation so as to reduce the scanning time. It further provides for a reduced cycle time, the result of which is a high sustaining frequency and a high luminance. The proposed control method also makes it possible to reduce the number of levels of voltages applied to the different electrodes, and to thus simplify the control electronic system. It must be noted that the method of the invention further enables the application, to the column electrode, of only pulses having relatively low power and amplsitude, thus permitting the use of integrated circuits manufactured at low cost.

According to the invention, there is proposed a method for the line-by-line control of a coplanar sustaining AC type of plasma panel, said panel comprising column electrodes intersecting with two classes of parallel electrodes, the first class of electrodes being formed by addressing-sustaining electrodes and the second class being formed by solely sustaining electrodes, each addressing-sustaining electrode forming, with a neighboring solely sustaining electrode, a pair of sustaining electrodes, each pair of electrodes corresponding to a row of pixels perpendicular to the column electrodes, the pixels being formed substantially at each intersection of a column electrode with a pair of electrodes, said method consisting in the application, between the two electrodes of each pair of electrodes, of a set of cyclical voltages with a period T during which there is a phase for the writing of pixels and a phase for the erasure of pixels, and during which sustaining discharges are generated, said set of cyclical voltages being formed by a first set of cyclical pulses applied to all the addressing-sustaining electrodes and by a second set of cyclical pulses to all the solely sustaining electrodes, a method wherein, for the erasure of the pixels, all the pixels of at least one given line of pixels are erased simultaneously by provoking erasing discharges between the two electrodes of the corresponding pair of electrodes.

BRIEF DESCRIPTION OF THE DRAWINGS

The invention will be better understood from the following description, given as a non-restrictive example, and made with reference to the appended drawings, of which.

DETAILED DESCRIPTION OF THE INVENTION

Figure 2:
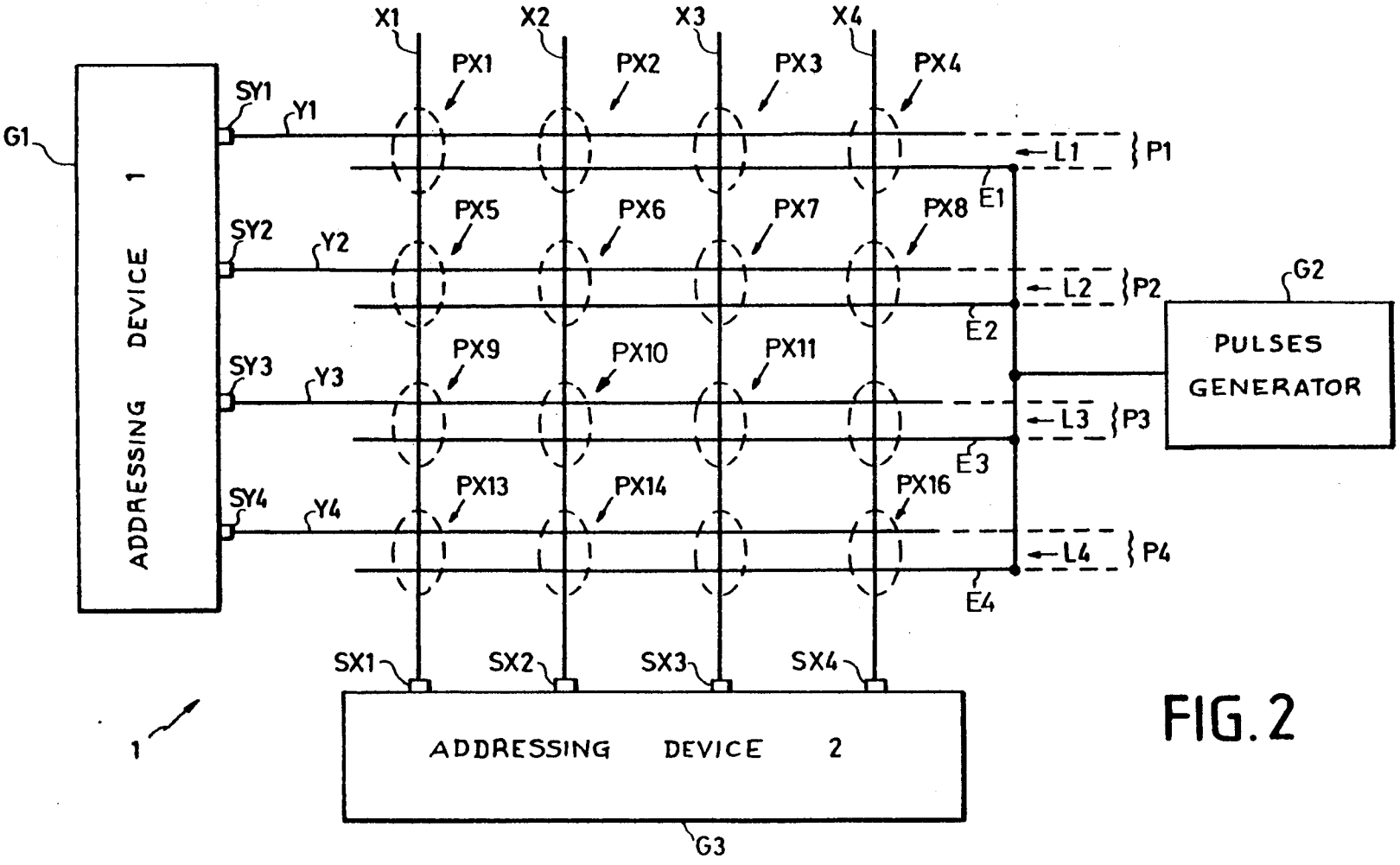
FIG. 2 gives a schematic view of a plasma panel to which the method of the invention may be applied.

FIG. 2 is a general schematic drawing of a plasma panel 1 to which the control method according to the invention may be applied. For the greater clarity of the figure, the plasma panel 1 is represented chiefly by conductors or electrodes arranged in columns X1, X2, X3, X4, called column electrodes, and by two classes of conductors or sustaining electrodes, arranged in rows, firstly Y1, Y2, Y3, Y4 for the first class and, secondly, E1, E2, E3, E4 for the second class.

Figure 1:
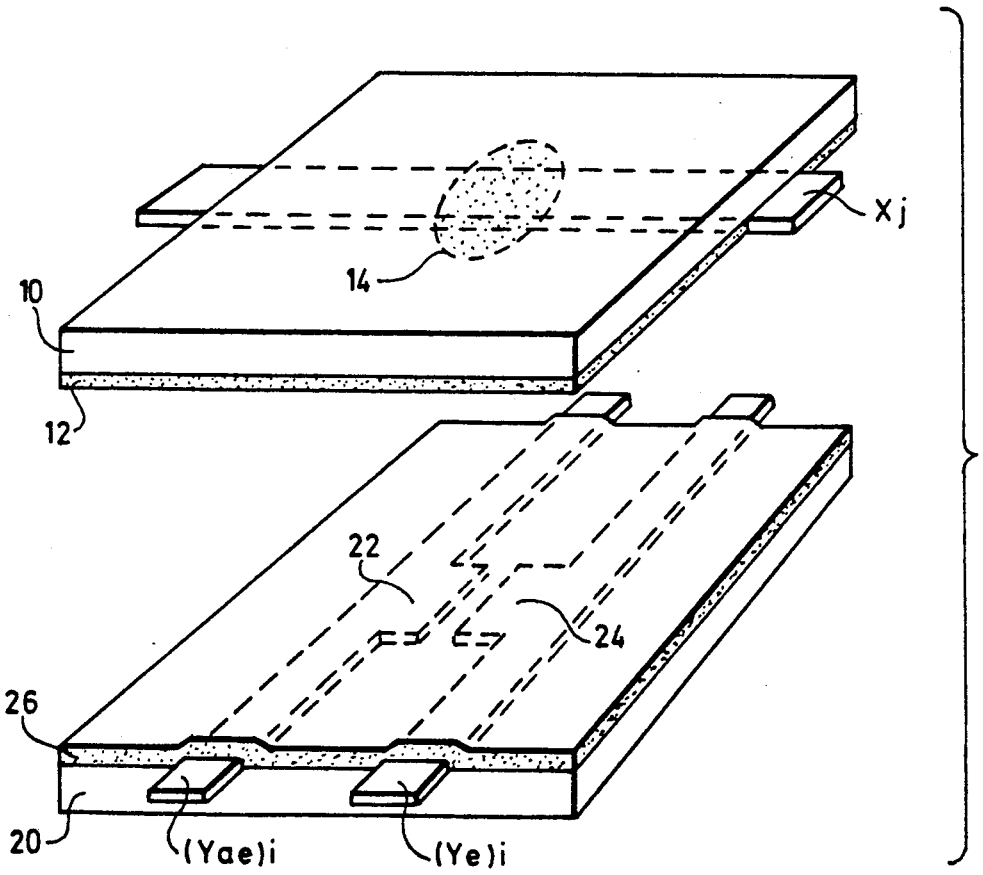
FIG. 1, already described, shows a new type of plasma panel to which the method of the invention can be applied.

Thus sustaining electrodes Y1 to Y4 and E1 to E4 are arranged in pairs, that is, a first electrode Y1 of the first class is associated with a neighboring electrode E1 belonging to the second class, to form a pair Pl of sustaining electrodes. A second electrode Y2 of the first class is associated with a second electrode E2 of the second class to form a second pair P2 of sustaining electrodes. The same is true of the electrodes Y3 and E3, then Y4 and E4, which respectively form a third and a fourth pair P3, P4 of sustaining electrodes. At each intersection of a column electrode X1 to X4 with a pair of electrodes P1 to P4, a picture element or pixel PX1 to PX16 is formed. This picture element or pixel is symbolized in FIG. 2 by a circle drawn with dashes. Each pixel may be formed, for example, according to the structure shown in FIG. 1, and the two electrodes of each pair of electrodes P1 to P4 may or may not have protuberances or projecting parts (not shown in FIG. 2) shown in FIG. 1 with the references 22, 24.

In the non-exhaustive example described, and for the greater clarity of the figure, only 4 electrodes X1 of each type have been shown, so that only 16 pixels PX1 to PX16 are formed. However, it is clear that the matrix arrangement of pixels may be far greater: it may be formed, for example, by the intersections of 1024 column electrodes with 1024 pairs of sustaining electrodes, each pair comprising an electrode of the first class Y with an electrode of the second class E.

The electrodes Y1 to Y4 of the first class are addressing-sustaining type electrodes and, consequently, these addressing-sustaining electrodes are individualized, i.e. the are each connected to a different output SY1 to SY2 of a first addressing device G1. The first addressing device G1 is of a type that is standard per se. It is capable of delivering sets of voltage pulses which shall be explained in greater detail with reference to FIG. 3*a*.

The electrodes E1 to E4 of the second group E are of the solely sustaining electrode type: in the non-restrictive example described, they are connected to one another and connected to the output SE of a pulse generating device G2 delivering voltage pulses which shall be explained in greater detail with reference to FIG. 3*b*.

The column electrodes X1 to X4 fulfil, in a standard way, solely an addressing role. They are each connected to a different output SX1 to SX4 of a second addressing device G3. The second addressing device G3 delivers voltage pulses which shall also be explained in a subsequent part of the description made with reference to FIGS. 3*d* to 3*g*.

The devices G1, G2, G3 are themselves controlled or synchronized, in a standard way, by a central control unit (not shown) which, in a manner known per se, manages the lighting up or extinguishing of the pixels PX1 to PX16, or the function of keeping these pixels PX1 to PX32 lit up or extinguished.

The control method according to the invention enables a row-by-row control: A row L1 to L4 is a row of pixels formed by the pixels PX1 to PX16 defined by each pair P1 to P4 of sustaining electrodes. Thus, the first row L1 contains the four pixels PX1 to PX4, and corresponds to the pair P1 of sustaining electrodes. the second row L2 contains 4 pixels PX5 to PX8 and corresponds to the second pair P2 of electrodes; the third row L3 contains the pixels PX9 to PX12 and corresponds to the second pair P3 of electrodes; the fourth row L4 contains the pixels PX13 to PX16 and corresponds to the fourth pair P4.

FIGS. 3*a* to 3*h* show diagrams of signals, explaining the working of the plasma panel 1 controlled according to the method of the invention.

To illustrate the working or operation obtained, we have shown, as a non-exhaustive example, those signals that are applied when it is sought to successively extinguish one pixel and light up another: thus, for example, on the second row L2 it is sought to extinguish (namely erase) the sixth pixel PX6 and light up (namely write) the seventh pixel PX7. It is noted that the sixth pixel is located at the intersection between the second pair of electrodes PE2 and the second column electrode X2, and that the seventh pixel PX7 is located at the intersection between the second pair of electrodes PE2 and the third column electrode X3.

FIGS. 3*a* to 3*b* respectively show a first set and a second set of cyclical pulses VY, VE which are applied, respectively, simultaneously to all the addressing-sustaining electrodes Y1 to Y4 and, simultaneously, to all the solely sustaining electrodes E1 to E4. FIG. 3*c* illustrates the sustaining discharges produced between the electrodes Y2 and E2 of the second pair P2 of electrodes. FIGS. 3*d*, 3*e*, 3*f*, 3*g* respectively show voltage pulses forming masking pulses applied to the column electrodes X1 to X4.

FIG. 3*h* shows a writing discharge DI between the third column electrode X3 and the second electrode Y2.

The first and second sets of voltages VY, VE vary on either side of one and the same reference voltage VR which is at zero volts for example.

The first and second sets of voltages VY, VE are respectively formed by a first set and a second set of voltage pulses having a cyclical character and a same period T. During this period T, the combination of the voltage pulses applied, firstly, to the addressing-sustaining electrodes Y1 to Y4 and, secondly, to the solely sustaining electrodes E1 to E4, develops voltages (not shown) between the two electrodes of each pair P1 to P4. These voltages determine a phase of erasure T1 and a writing phase (selective addressing) T2. In the non-restrictive example described, the cycles T further comprise a sustaining stage T3 which is optional, as explained in greater detail below in the description.

During the sustaining phase T3, the voltages VY and VE have opposite biases. Thus, for example, in FIG. 3*b*, at the instant t0, there starts a sustaining square pulse CEe which is applied to the solely sustaining electrodes E1 to E4. The transition of this sustaining square pulse represents a variation in voltage ΔVE which, in the example, occurs substantially symmetrically with respect to the reference voltage VR. This first sustaining square pulse CEe, applied to the solely sustaining electrodes E1 to E4 passes, for example, to a negative bias, from a voltage +VE1 to a voltage −VE1.

At the same time, at the instant t0, there starts a sustaining square pulse CEY applied to the sustaining-addressing electrodes Y1 to Y4. This sustaining square pulse CEY has a positive bias, i.e. one that is opposite the bias which, at the same time, is applied to the solely sustaining electrodes E1 to E4, the transition having been done at the instant t0, from a negative voltage −VY1 to a positive voltage +VY1. In the non-restrictive example described, this transition represents a variation in voltage ΔVY1 which occurs substantially symmetrically with respect to the reference voltage VR.

Assuming that, before the instant t0, the sixth pixel was in the written state: charges (not shown) were stored at the dielectric of the second electrodes Y2, E2 of the second pair P2, at the sixth pixel PX6, and the transitions at the instant t0 of the sustaining square pulses CEY and CEe develop an electrical field at the sixth pixel PX6, the effect of which is added to that of the already stored charges to cause a sustaining discharge Del (FIG. 3*c*). This sustaining discharge lasts substantially up to an instant t1 when charges with biases opposite to the preceding ones are generated in a manner known per se.

The sustaining discharges CEY and CEe, respectively applied to all the addressing-sustaining electrodes Y1 to Y4 and all the sustaining electrodes E1 to E4 are maintained up to an instant t2. At this instant t2, the biases of the voltages VY and VE get reversed and remain opposite until an instant t4 which marks the start of the erasure phase T1. It is noted that, at the instant t2, the transition of the sustaining square pulses CEY and CEe causes a new sustaining discharge De2 at the sixth pixel PX6. As for the previous sustaining discharge, this discharge comes to an end at the instant t3 where the charges collected at the sustaining electrodes YE, E2, with a bias opposite to the one they had at the instant t2, are sufficient in quantity to cause extinguishing.

At the instant t4, when the erasing phase T1 starts, the biases of the voltages VE and VY, respectively applied to the sustaining electrodes E1 to E4 and to the addressing-sustaining electrodes Y1 to Y4 get reversed again and remain opposite. It is noted that the square pulses applied to the solely sustaining electrodes always have the same amplitude ΔVE, namely that only two voltage levels (+VE1 and −VE1) are needed to control these sustaining electrodes E1 to E4.

At the instant t4, the voltage VE is formed by a voltage square pulse of positive bias which is applied to the solely sustaining electrodes E1 to E4 while, at the same time, a square pulse CBE with opposite bias, namely negative bias, is applied to the addressing-sustaining electrodes Y1 to Y4. However, this square pulse Cbe reaches a value VY2 which is lower than the value VY1, and it preserves this value VY2 until an instant t7, when the bias of the voltage VY again gets reversed.

Under these conditions, at the instant t4, the transition of the square pulse CBe, applied to the sustaining-addressing electrodes Y1 to Y4, has a value ΔVY2 which is smaller than the value ΔVY1 of a sustaining square pulse CEY, so that the potential developed between the electrodes Y1 to Y4 and E1 to E4 is not enough to cause a sustaining discharge, even if it gets added to the effect of the charges already stored at these sustaining electrodes. The square pulses applied to the addressing-sustaining electrodes Y1 to Y4 at the instant t4 are designed to form a voltage step or base called an erasure base square pulse CBe on which there is superimposed, solely on the square pulse applied to the addressing-sustaining electrode of the addressed pair P1 to P4 (namely, in the present case, only the square pulse applied to the second addressing-sustaining electrode Y2), a voltage pulse called an erasure pulse IE, IE'.

The erasure pulse may have the shape of a rectangular square pulse having either a high amplitude and a short duration or a low amplitude and a long duration or, again, it may be formed by a pulse with a rising edge that is set up relatively slowly and forms a slope, as explained in the above-mentioned French patent application No. 78 04893, filed on behalf of THOMSON-CSF and published under No. 2 417 848, which should be considered as forming part of the present description.

In the non-restrictive example described, the erasure pulse IE (shown in dashes), which is superimposed on the erasure base square pulse CBe, is a pulse with a rising edge R that is established relatively slowly, as described in the above-mentioned patent, until it reaches substantially the first value VY1. However, the erasure pulse could also be formed by a pulse IE' (shown with dots and dashes) with a relatively short duration, which would be superimposed on the erasure base square pulse CBe starting, for example, from the instant t4. Of course, the erasure square pulse IE, IE' is not superimposed on an erasure base square pulse CBe except for the pair of electrodes P1 to P4 addressed. Given the example described, it is only to the second addressing electrode Y2 that an erasure base square pulse CBe is applied. On this erasure base square pulse CBE, there is superimposed a erasure pulse IE, IE'. Assuming that the erasure pulse is the one for which the rising edge forms a slope R, the superimposition of this erasure pulse IE with the base square pulse will give rise, substantially at the instant t5, when the slope R substantially reaches the first value VY1, an erasure discharge DEF between the second addressing-sustaining electrode Y2 and the second solely sustaining electrode E2, at the level of each pixel. This erasing discharge is lower in intensity thasn the sustaining discharges DE1, DE2 and ceases substantially at an instant t6 without giving rise to the accumulation of charges as in the case of the sustaining discharges DE1, DE2. In this configuration, all the pixels PX5 to PX8 of the second pair are erased.

Thus, it is noted that a major characteristic of the method of the invention consists in generating a erasing discharge only between the two sustaining electrodes Y2, E2 of one and the same given pair P2, this erasing discharge DEF having the effect of erasing all the pixels that correspond to this pair P2 of electrodes.

It must be noted that, for the rows of pixels L1, L3, L4 or pairs of electrodes P1, P3 and P4, the addressing-sustaining electrode Y1, Y3, Y4 of which receives no erasing pulse IE, IE' the presence of the erasure base square pulse CBE has no effect: all the pixels that are erased stay erased, and all the pixels that are written stay written. That is, the charges that existed on the two electrodes of a pair of sustaining electrodes, at the instant t3 for example, subsist until an instant t8 which marks the start of the writing stage T2 and at which sustaining discharges may occur at the level of the written pixels.

According to another characteristic of the invention, after the erasure of all the pixels of a given pair P1 to P4 of sustaining electrodes, the second pair P2 in the example, the writing of the desired pixels belonging to this pair p2 of electrodes is done in causing a writing discharge between the second addressing-sustaining electrode Y2 and each of the column electrodes X1 to X4, for which the intersection with the second addressing-sustaining electrode Y2 represents a pixel that it is sought to write. Thus, in the case that has been foreseen, namely the writing of the seventh pixel PX7, a writing discharge is made solely between the second addressing-sustaining electrode Y2 and the third column electrode X3. This is done during the writing phase T2 which starts at the instant t8.

It is noted that, at the instant t7, which corresponds to the end of the erasure base square pulse CBe, the biases of the voltages VY, VE, applied respectively to the addressing-sustaining electrodes Y1 to Y4 and E1 to E4 get reversed. The bias of the voltage VE becomes positive and remains so until the instant t8, and the bias of the voltage VY becomes negative and remains so until the instant t8. The interval of time Δt1 between the instant t7 and the instant t8 makes it possible, if necessary, to stabilize the erasure that has been done. This stabilization depends on the particular characteristics of the plasma panel used, so that the time interval Δt1 may, as the case may be, be reduced or even eliminated. This enables a reduction in the duration of the period T (which represents the base cycle). This base cycle may have an even smaller duration as shown, for example, by the duration T', in eliminating the square pulses that belong to the sustaining phase T3. This is made possible by the fact that even by eliminating the sustaining phase T3, the control method according to the invention can be used to obtain sustaining discharges through the writing phase T2.

At the instant t8, the voltage VE becomes negative. The voltage VY becomes positive by a voltage square pulse CBi applied to the addressing-sustaining electrodes Y1 to Y4. The voltage VY then goes to the value VY1, giving a variation ΔVY1 by which it is possible to obtain sustaining discharges for all the written pixels. Thus, for example, if the sixth pixel P6 had not been erased (at the same time as all the other pixels of the second row L2), charges would have been kept at the electrodes Y2 and E2 which would have allowed a sustaining discharge De3 (shown in dashes) to be produced at the instant t8.

To write the pixel or pixels of a row or a given pair of electrodes, a writing square pulse CI is superimposed on the voltage square pulse CBi which, between the instant t8 and an instant t12, is applied to all the addressing-sustaining electrodes. Of course, a writing square pulse CI is superimposed only on the writing base square pulse CBi which is applied to the desired address, namely, in the example, the second pair of addressing-sustaining electrodes Y2 of the second pair 2. The voltage square pulse CBi thus forms a writing base square pulse forming a voltage step to which the voltage of the writing square pulse CI is added, but it also forms a sustaining square pulse for the pairs P1, P3, P4 of the other non-addressed addressing-sustaining electrodes Y1, Y3, Y4.

The writing square pulse CI, superimposed on the writing base square pulse CBi, reaches a voltage value of VY3 such that the potential difference which is then created between the column electrodes X1 to X4 and the second addressing-sustaining electrode Y2, may provoke a discharge, called a writing discharge, at the intersection between the latter electrode and the column electrodes X1 to X4. Hence, only the desired pixel or pixels are written by applying, to the column electrodes X1 to X4 which correspond to the pixels that should not be written, a voltage pulse, called a masking pulse MX1 to MX4, with the same bias as the writing square pulse CI. This means that the potential needed to produce a discharge between a column electrode X1 to X4 and the electrode Y2 is achieved solely with the column electrode to which no so-called masking pulse is applied. Of course, if a masking pulse is applied to all the column electrodes X1 to X4, none of the pixels is written. In the non-restrictive example described, and as illustrated in FIGS. 3*d*, 3*e*, 3*f*, 3*g*, the column electrodes X1 to X4 are carried to the potential of the reference voltage VR, except during the writing phase T2 when a masking pulse, which carries their voltage to a value VX, may be applied to them.

In the example described, where it is the seventh pixel PX7 that it is sought to write, a masking pulse MX1, MX2, MX4 is applied to the first, second and fourth column electrode X1, X2, X4 for at least the duration of the writing square pulse CI and no masking pulse is applied to the third column electrode X3. The result thereof is that, substantially at an instant t10, there is a writing discharge DI (illustrated in FIG. 3*h*) between the second addressing-maintenance electrode Y2 and the third column electrode X3, at the intersection of these electrodes, namely at the seventh pixel PX7. The end of the writing square pulse CI takes place substantially at the same time as the end of the writing base square pulse, at an instant t11 which, for example, precedes the instant t12 of the end of the writing base square pulse to a very slight extent.

It must be noted that, to prevent an undesirable discharge between the second addressing-sustaining electrode Y2 and the second sustaining electrode E2, the potential difference between these two electrodes is reduced by reversing the bias of the voltage VE applied to the electrodes E1 to E4 before the superimposition of the writing square pulse CI on the writing base square pulse CBi takes place. From the instant t8 onwards, the voltage VE goes from positive to negative and forms a square pulse CNE with positive bias. Then the bias of the voltage VE (applied to the solely sustaining electrodes E1 to E4) is again reversed at an instant t9 and has a positive bias. This is substantially at the same time or a little before the start of the writing square pulse CI or, at any rate, before an instant t10 when the writing square pulse CI reaches the value VY3. The voltage VE then has the same bias as the voltage VY applied to the addressing-sustaining electrodes, and there then exists, between the second sustaining relectrode E2 and the second addressing-sustaining electrode Y2, a potential difference which is not enough to provoke a stray discharge during the superimposition of the writing square pulse CI.

It must be noted that an advantage provided by this arrangement lies in the fact that the masking pulses MX1 to MX4 are produced with a relatively low power (due to the fact that it is with the sustaining discharges that it is sought to produce the light emitted by the pixels) and with a relatively low voltage amplitude, so that standard, low-priced components can be used to control the column electrodes X1 to X4. It is further noted that a particularly important advantage, provided by the method according to the invention, lies in the fact that the discharge occurs solely for the pixels to be written and not for all the pixels of the row. This tends to considerably increase the longevity of the luminophors which are used, as the case may be, for the transmission of light in color.

An indication is given below, purely as a non-restrictive example, of the voltage values which may be used to implement the method according to the invention, with a standard type of plasma panel:

The variations ΔVE of the voltage VE may be of the order of 100 volts;

For the voltage VY, the variations ΔVY1 may be of the order of 150 volts, the variations ΔVY2 may be of the order of 80 volts;

The masking pulses applied to the column electrodes X may have an amplitude of the order of 40 volts;

The writing square pulses CI may have an amplitude of the order of 80 volts. Of course, these values are given purely by way of example, and can be easily modified as a function of the characteristics of the plasma panel used.

At the instant t12, the end of the writing base square pulse CBi corresponds to the end of the writing phase T2, and corresponds to a reversal of the bias of the voltage VY applied to the addressing-sustaining electrodes Y1 to Y4. This bias becomes negative. The voltage VE applied to the sustaining electrodes E1 to E4 is positive substantially from the instant t9 and, in the non-restrictive example described, it preserves this positive bias until an instant TO' which marks the start of a new cycle. It must be noted that the writing discharge DI has given rise to the collection of negative charges (not shown) on the dielectric of the second addressing-sustaining electrode Y2 at the seventh pixel PX7. Hence, to the positive-to-negative transition of the first voltage VY, due to the end of the writing square pulse CI and of the writing base square pulse CBi, there is added the effect of the presence of the negative charges that have collected at the electrodes Y2 so that, substantially when the voltage VY reaches the negative value −V1, there is a resumption of sustaining discharge DRE (FIG. 3*c*) at the seventh pixel PX7, between the second addressing-sustaining electrode Y2 and the second sustaining electrode E2. Following this resumption of sustaining discharge, charges can again collect, at both electrodes of the second pair P2 at the same time.

The voltages VY and VE preserve their respectively negative and positive bias until the instant t0' when a new cycle starts. It must be noted that, according to the characteristics proper to the plasma panel used, it is possible for a discharge (shown in dashes in FIG. 3*h*) to occur substantially at the instant t12 between the column electrode X3 and the addressing-sustaining electrode Y2. In a case such as this, a sustaining resumption discharge (shown in dashes in FIG. 3*c*) occurs at the instant t0' of the start of a new cycle.

It must be noted that the base cycle is applied to all the sustaining electrodes with a frequency that depends on the duration of the period T, T'. Given the fact that there are incompressible periods, notably the periods needed for the control of the ancillary circuits (not shown), the duration of the period T, T' can hardly go below 22 microseconds or 20 microseconds. However, this enables very worthwhile performances to be obtained, even with a plasma panel having a large number of lines. In taking, for example, a plasma panel with 1,000 lines, 20 milliseconds are needed to obtain 50 images per second.

Figure 3:
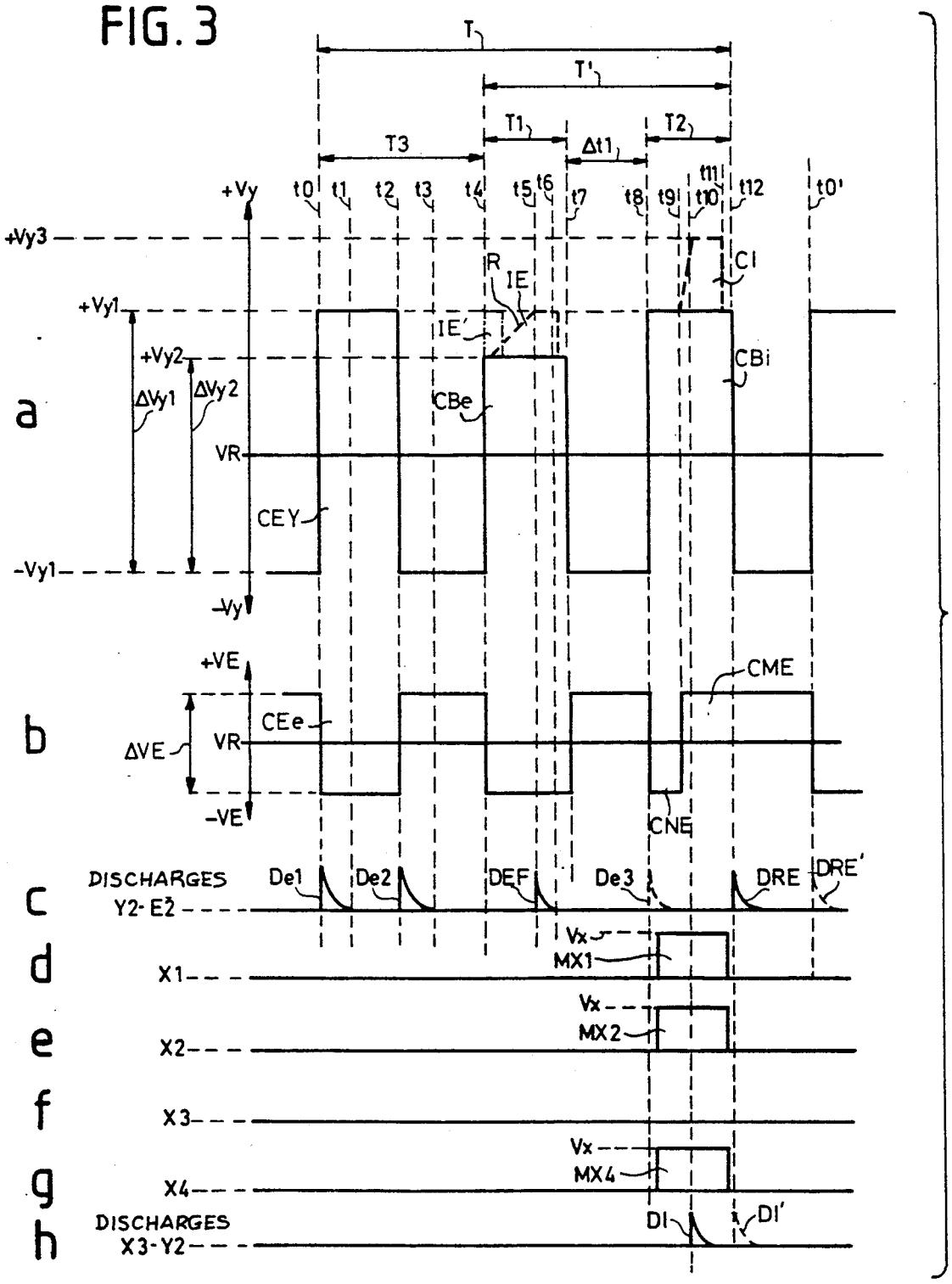
FIGS. 3*a* to 3*h* show signals which explain the working of the plasma panel shown in FIG. 2 and controlled by the method according to the invention.

The following are an indication, given purely as a non-restrictive example, of the possible durations of the different signals shown in FIGS. 3:

The sustaining pulses CEY and CEe have a standard duration of some microseconds. The erasing base square pulse CBe may have a duration of the order of 5 microseconds. The time interval Δt1 may be of the order of 3 to 4 microseconds. The writing base square pulse CBi may have a duration of the order of 7 microseconds, and the writing square pulse Ci which is superimposed on it may have a duration of about 4 microseconds and/or possibly have a same shape as the erasing pulse IE, the rising edge of which forms a slope R, and the duration at the peak of which may be of the order of zero to some microseconds. The negative square pulse, marked CNE on the voltage VE, may have a duration of the order of 3 microseconds.

On the voltage VE, it is observed that the negative square pulse CNE is followed by a positive square pulse (starting from the instant t9 onwards). This positive square pulse consists, in its part formed between the end of the negative square pulse CNE and the instant t12 of the end of the writing base square pulse, by a masking square pulse CME which fulfils a function of inhibiting the writing square pulse CI with respect to the second solely sustaining electrode E2, with a view to preventing a stray discharge between this second electrode E2 and the second addressing-sustaining electrode Y2.

It must be noted that the variations in voltages VY and VE, respectively applied to the addressing-sustaining electrodes Y1 to Y4 and to the so-called solely sustaining electrodes E1 to E4, ΔVE and ΔVY1 for example, have different amplitudes, unlike the general practice in the prior art. But, of course, these variations in voltages can be adapted to have similar amplitudes. However, with the control method according to the invention, it is worthwhile to have a disymmetry between the values of the voltage square pulses applied, firstly, to the addressing-sustaining electrodes Y1 to Y4 and, secondly, to the so-called solely sustaining electrodes E1 to E4, in order to more easily generate a writing discharge which generates enough charges to facilitate the resumption of sustaining discharges between the addressing-sustaining electrode Y1 to Y4 concerned and the corresponding so-called solely sustaining electrode E1 to E4, without having to bring charges to this electrode E1 to E4.

What is claimed is:

1. A method for the line-by-line control of a coplanar sustaining AC type of plasma panel, said panel comprising column electrodes intersecting two classes of parallel electrodes, the first class of electrodes being formed by addressing-sustaining electrodes and the second class being formed by so-called solely sustaining electrodes, each addressing-sustaining electrode forming, with a neighboring solely sustaining electrode, a pair of sustaining electrodes, each pair of electrodes corresponding to a row of pixels perpendicular to the column electrodes, the pixels being formed substantially at each intersection of a column electrode with a pair of electrodes, said method consisting in the application of a first set of cyclical pulses to all the addressing-sustaining electrodes and a second set of cyclical pulses to all the so-called solely sustaining electrodes, both sets of pulses having one and the same period during which said pulses develop, between the electrodes of each pair of electrodes, voltages that form an erasing phase and a writing phase, and generate sustaining discharges, a method wherein a full given row of pixels is erased during the erasure stage, in provoking, erasing discharges solely between the addressing-sustaining electrode and the so-called solely sustaining electrode of the corresponding pair.

2. A control method according to claim 1, wherein the sustaining dicharges are provoked by the application, to all the addressing-sustaining electrodes, of at least one square pulse having a first bias, and by the application, to all the so-called solely sustaining electrodes, of at least one second square pulse having a second bias, said first and second square pulses respectively having a first and a second amplitude, a method wherein, during the erasure stage, an erasure base square pulse is applied to all the addressing-sustaining electrodes, said erasure base square pulse having a third amplitude which is lower than the first amplitude, and there is applied, at the same time, to all the so-called solely sustaining electrodes, a square pulse that is similar to the second square pulse and has a bias opposite to that of said erasure base square pulse, and wherein an erasure pulse is superimposed solely on the erasure base pulse which is applied to the addressing-sustaining electrode corresponding to said given row of pixels.

3. A control method according to claim 2, wherein the erasure pulse is formed by a pulse, the rising edge of which forms a slope that is set up relatively slowly.

4. A control method according to claim 2, wherein the erasure pulse is a relatively brief pulse.

5. A control method according to claim 2 wherein, for the writing of at least one pixel of a given row, the pixels of which have been erased beforehand, a writing base square pulse is applied to all the addressing-sustaining electrodes, said writing base square pulse having a first bias and having substantially the first amplitude, and a writing square pulse having the first bias is superimposed solely on the writing base square pulse which is applied to the addressing-sustaining electrode corresponding to said given line and, substantially at the same time, voltage pulses having a same first bias are applied to all the column electrodes except for those used to define a pixel to be written, and wherein, furthermore, substantially during the time when the writing square pulse is superimposed, a voltage square pulse, having said first bias and forming a second masking pulse is applied to all the so-called solely sustaining electrodes.

6. A control method according to claim 1 wherein, during said period, there is a sustaining phase during which all the addressing-sustaining electrodes receive at least one sustaining square pulse and wherein, at the same time, a voltage pulse of opposite bias is applied to all the so-called solely sustaining electrodes.

7. A control method according to one of the claims 5 or 6 wherein, substantially at the instant when the writing base square pulse starts, a square pulse having said second bias is applied to all the so-called solely sustaining electrodes so as to generate sustaining discharges for the non-erased pixels.

8. A control method according to claim 7 wherein said square pulse having the second bias and starting at the same time as the writing base square pulse ends before or substantially at the same instant as the instant when the erasure pulse starts.

9. A control method according to claim 5, wherein there is applied, to all the so-called solely sustaining electrodes, a voltage having the first bias at the instant when the writing base square pulse ends and when the voltage applied to all the addressing-sustaining electrodes gets reversed to achieve the second bias, so as to generate a resumption discharge between the two electrodes of the concerned pair of electrodes at each of the pixels that have just been written.

10. A control method according to claim 1, wherein the pulses applied to the solely sustaining electrodes have an amplitude smaller than the amplitude of the pulses applied to the addressing-sustaining electrodes.

11. A control method according to claim 1, wherein the pulses applied to the solely sustaining electrodes always have the same amplitude.

* * * * *